US005647778A

United States Patent [19]

Yamaguchi et al.

[11] Patent Number: 5,647,778

[45] Date of Patent: Jul. 15, 1997

[54] ELECTRICAL CONNECTOR

[75] Inventors: Noboru Yamaguchi; Masaya Yamamoto, both of Shizuoka, Japan

[73] Assignee: Yazaki Corporation, Tokyo, Japan

[21] Appl. No.: 629,871

[22] Filed: Apr. 10, 1996

[30] Foreign Application Priority Data

Apr. 13, 1995 [JP] Japan ..... 7-088354

[51] Int. Cl.[6] ..... H01R 13/447

[52] U.S. Cl. ..... 439/752; 439/595

[58] Field of Search ..... 439/752, 595, 439/744

[56] References Cited

U.S. PATENT DOCUMENTS 5,051,100 9/1991 Kato et al. ..... 439/595

5,232,373 8/1993 Samada ..... 439/595

FOREIGN PATENT DOCUMENTS 5-36778 5/1993 Japan ..... H01R 13/64

*Primary Examiner*—David L. Pirlot

*Assistant Examiner*—T. C. Patel

*Attorney, Agent, or Firm*—Sughrue, Mion, Zinn, Macpeak & Seas

[57] ABSTRACT

A connector with a cover used for connecting wires to a printed circuit board or the like, in which an incompletely-inserted condition of a terminal received in a housing can be perfectly detected. A cover-holding rib is formed on an upper surface of a housing body, and a cover, having an engagement groove in which the rib is fitted, is slidably mounted on an upper portion of the housing body. When the cover is opened to be received in a retainer fitted on the housing body, contact piece portions of terminals are exposed from the housing body.

5 Claims, 5 Drawing Sheets

ELECTRICAL CONNECTOR

BACKGROUND OF THE INVENTION

1. Field of the Invention

This invention relates to a connector for connecting wires to a printed circuit board or the like.

2. Description of the Related Art

There is known a connector for a printed circuit board which can be inserted and fitted in a mating casing, containing the printed circuit board, so as to make an electrical connection to the printed circuit board.

One such connector as disclosed in Japanese Utility Model Unexamined Publication No. Hei. 5-36778 will now be described with reference to FIGS. 9(A) to 9(C) and 10. In this connector 100, terminals 103 each having a wire 105 connected thereto are received respectively in terminal receiving chambers 102 in a housing body 101. Each terminal 103 has a contact piece portion 104 for contact with a corresponding contact terminal of a printed circuit board when the connector is inserted and fitted in a cavity portion in a mating casing (not shown), and the contact piece portions 104 of the terminals 103 can be exposed from the housing body 101.

More specifically, a cover 106 for protecting the contact piece portions 104 is slidably mounted on the housing body 101, and when the connector 100 is fitted, the cover 106 is opened to expose the contact piece portions 104.

The connector 100 also includes a retainer 107 releasably mounted on the housing body 101.

In a provisionally-retained condition (FIG. 9(A)) in which the retainer 107 is in slightly floated relation to the housing body 101, the retainer 107 allows the terminals 103 to be inserted into the respective terminal receiving chambers 102. The retainer 107 has projections 107*a* for engagement with the rear ends of the respective terminals 103 in a completely-retained condition (FIG. 9(B)) in which the retainer 107 is completely received in the housing body 101. The projection 107*a* engages with the rear end of the terminal 103 to prevent the terminal 103 from being withdrawn rearwardly from the housing body 101. The retainer 107 has cover movement grooves 108 for receiving the cover 106 when the cover 106 is slidingly moved at the time of fitting of the connector 100, as shown in FIG. 9(C).

Therefore, in the connector 100, if any terminal 103 is incompletely inserted, the projection 107*a* contacts the terminal 103, so that the retainer 107 can not be shifted from the provisionally-retained condition to the completely-retained condition, and besides the cover movement grooves 108 are not disposed at their respective predetermined positions, as shown in FIG. 10. As a result, the retainer 107 prevents the sliding movement of the cover 106 mounted on the housing body 101, thus enabling this condition to be clearly detected through the terminal 103.

However, where the above connector had a multi-pole construction, and hence had an increased width (in a direction perpendicular to the sheets of FIGS. 9(A) to 9(C) and 10), there were occasions when the incomplete insertion of the terminal could not be satisfactorily detected. More specifically, in such a multi-pole construction, when the incompletely-inserted terminal was disposed particularly at a central portion of the connector, a central portion of the retainer was slightly deformed or bulged outwardly, and was shifted into the completely-retained condition, and also the cover was slightly deformed only at its central portion, and was slidingly moved. As a result, the incomplete insertion of the terminal could not be detected, so that a good connection to the printed circuit board could not be achieved.

SUMMARY OF THE INVENTION

With the above problems in view, it is an object of this invention to provide a connector in which even in a multi-pole construction, an incompletely-inserted terminal can be positively detected, thereby preventing a detective product from being produced.

To achieve the above object, the invention provides a connector comprising: a housing body having a rib which is formed on and projects from an upper surface thereof; a terminal incorporated in the housing body; and a cover, having an engagement groove in which the rib is fitted, slidably mounted on the housing body so as to expose the terminal by opening the cover, wherein the cover is engaged with the rib to be prevented from being elastically deformed, and disposed so as to be received in a retainer fitted on the housing body.

DETAILED DESCRIPTION OF THE PREFERRED EMBODIMENTS

A preferred embodiment of a connector of the present invention will now be described with reference to the drawings.

Figure 1:
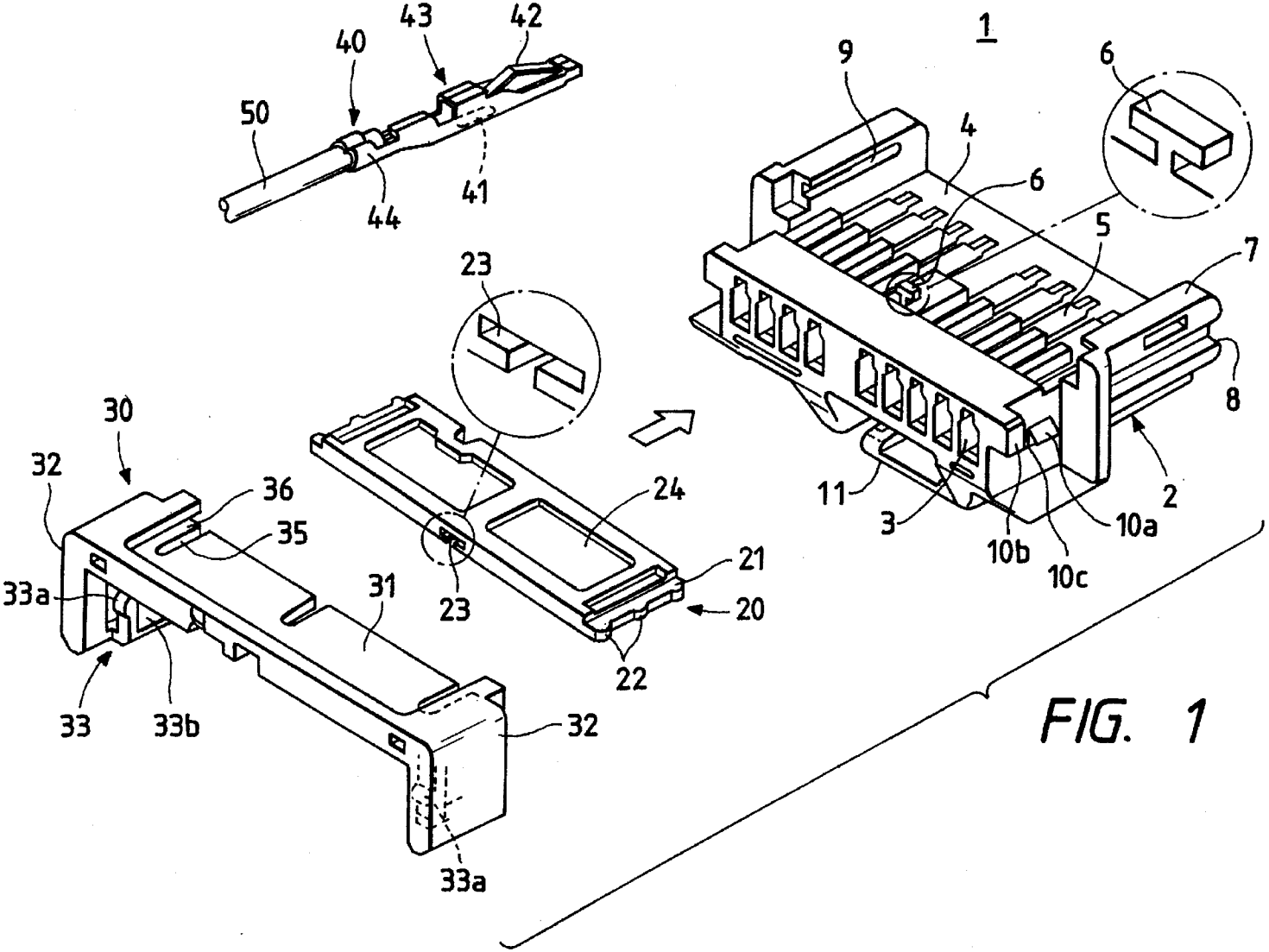
FIG. 1 is an exploded, perspective view of a preferred embodiment of a connector of the present invention.
Figure 2:
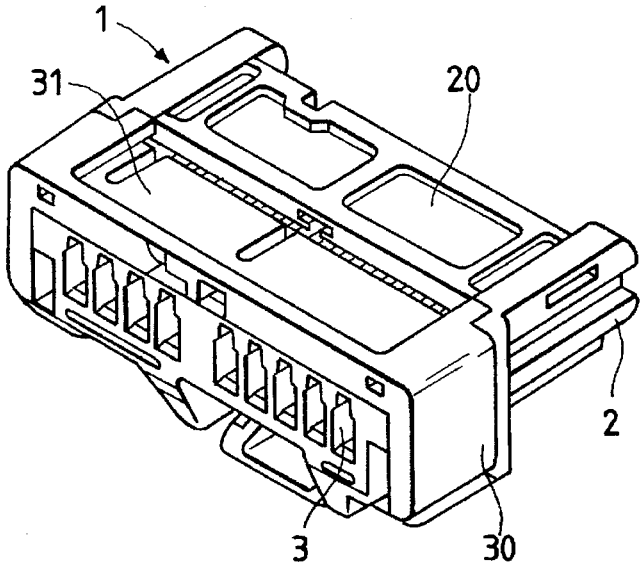
FIG. 2 is a perspective view showing the appearance of the connector in its assembled condition.

FIG. 1 is an exploded, perspective view of the connector of the invention, and FIG. 2 is a perspective view showing the appearance of the connector in its assembled condition. In FIG. 2, the showing of terminals and wires is omitted.

The connector 1 of the present invention comprises a rectangular housing body 2 molded of a resin, a cover 20 for sliding movement over an upper surface 4 of the housing body 2, a retainer 30 which engages with a rear end portion of the housing body 2 to prevent the terminals from disengagement, and can receive the cover 20, and the terminals 40 incorporated in the housing body 2.

The terminal 40 is formed from an electrically-conductive metal sheet by blanking, and includes an electrical contact portion 43, and a wire connection portion 44 which is formed at a rear end of the terminal, and is clamped and electrically connected to the wire 50. The electrical contact portion 43 has an engagement hole 41 formed in the reverse side of the terminal at a substantially central portion thereof, and also has a contact piece portion 42 of a folded-back construction extending from the front end toward the central portion.

The housing body 2 has a plurality of (nine in this embodiment) terminal receiving chambers 3 juxtaposed in the rectangular body, and notches 5 for respectively exposing the contact piece portions 42 of the terminals 40 are formed in the upper surface 4 of the housing body, and are disposed in registry with the terminal receiving chambers 3, respectively.

A rib 6 of a T-shaped cross-section, which is one of important features of the present invention, is formed on that portion of the upper surface 4 disposed substantially centrally of the width thereof. The rib 6 serves to prevent the cover 20 from being raised by elastic deformation thereof.

Each of opposite side plates 7 of the housing body 2 has a rugged outer surface 8 at the front portion of the connector, and a slide groove 9 is formed in the inner surface of the side plate 7, and extends in a forward-backward direction. The rugged surfaces 8 serve as guide means during the time when the connector 1 is inserted and fitted in a mating casing 60 (see FIG. 3), and also serve as wrong insertion prevention means for preventing the connector 1 from being inserted in an inverted manner. The terminal protecting cover 20 can be slidably received in the slide grooves 9.

Each of the opposite side plates 7 has a provisionally-engaging projection 10*a* and a completely-engaging projection 10*b* at the rear portion of the connector, and these projections 10*a* and 10*b* constituting retaining means for the retainer 30. A lock arm 11 for locking the connector relative to the casing 60 is formed on the lower surface of the housing body 2.

The cover 20 is substantially in the form of a flat plate, and has right and left ends of a stepped configuration extending in a sliding direction. Lower portions 21 of these stepped right and left ends, which are directed away from each other, can be inserted into the slide grooves 9, respectively. A plurality of projections 22 are formed on an edge of each of the lower portions 21, and the projections 22 on one lower portion 21 and the projections 22 on the other lower portion 21 are symmetrical. The provision of the projections 22 reduces the areas of sliding contact of the cover 20 with inner surfaces of the slide grooves 9, thereby enhancing the sliding ability of the cover 20.

An engagement groove 23, corresponding in shape to the rib 6, is formed in the lower surface of the cover 20 at a widthwise central portion thereof, and extends in the direction of sliding movement. The rib 6 can be received in the engagement groove 23. Right and left upper surface portions 24, disposed respectively at opposite sides of the engagement groove 23, are partially reduced in thickness, and this contributes to a lightweight design of the cover 20, and also reduces the amount of the material used.

The retainer 30 has a substantial U-shape, and includes a horizontal plate 31, and a pair of side plates 32 depending respectively from opposite ends of the horizontal plate 31. Opposed retaining portions 33 each having a retaining projection 33*a* are formed on and project from inner surfaces of the opposite side plates 32, respectively. The retaining portions 33 cooperate with the provisionally-engaging projections 10*a* and the completely-engaging projections 10*b* of the housing body 2 to form retaining means, and when the retainer 30 is pushed to fit on the housing body 2 from the upper side in a direction intersecting the terminal-inserting direction, each retaining portion 33 is sequentially brought into engagement with the associated provisionally-engaging projection 10*a* and completely-engaging projection 10*b* in a stepped manner. Namely, the retainer 30 can be selectively held in a provisionally-retained position or a completely-retained position, depending on the depth of fitting of the retainer 30.

Detection projections 34 (see FIGS. 5 to 7) are formed on the lower surface of the horizontal plate 31 of the retainer 30, and in the completely-retained condition of the retainer 30, the detection projections 34 are inserted respectively into the terminal-receiving chambers 3 through the respective notches 5 in the housing body 2 to thereby detect the inserted conditions of the respective terminals. Three slits 35 are formed through the horizontal plate 31, and extend from the front side thereof toward the rear side thereof in the terminal-inserting direction. Namely, the horizontal plate 31 can be substantially pivotally moved because of the provision of the slits 35, and the slits 35 divide the horizontal plate 31 into two sections, while dividing the terminal receiving chambers 3 into two groups.

A cover movement groove 36 is formed between the upper portion of each side plate 32 and the horizontal plate 31, and these cover movement grooves 36 receive the cover 20 when the cover 20 is slidingly moved over the upper surface of the horizontal plate 31.

A procedure of assembling the connector 1 will now be described with reference to FIG. 1.

First, the engagement groove 23 in the cover 20 is fitted on the rib 6, and the two lower portions 21 are engaged in the slide grooves 9, respectively, and in this condition, the cover 20 is slidingly moved over the upper surface 4 of the housing body 2 from the rear side of the housing body 2, so that the cover 20 is received in the slide grooves 9. Then, the retainer 30 is moved or pushed downward from the upper side to fit on the rear portion of the housing body 2 until a lower piece portion 33*b* of each retaining portion 33 slides over the associated provisionally-engaging projection 10*a* of the housing body 2 to be located beneath this projection 10*a*. In this provisionally-retained condition of the retainer 30, the retaining projection 33*a* of each retaining portion 33 is held against a slanting surface 10*c* of the associated completely-engaging projection 10*b*, thereby preventing the disengagement of the retainer 30 from the housing body 2 and the shifting of the retainer 30 into the completely-retained condition. In this condition, the retainer 30 is held in slightly-floating relation to the housing body 2, and the detection projections 34 are held out of the respective terminal receiving chambers 3. Namely, in this provisionally-retained condition, the terminals 40 can be inserted into the respective terminal receiving chambers 3. Therefore, each terminal 40 having the wire connected thereto is inserted into the associated terminal receiving chamber 3, with the engagement hole 41 directed downwardly.

The manner of inserting the terminal 40 will now be described with reference to FIGS. 4 to 7.

Figure 4:
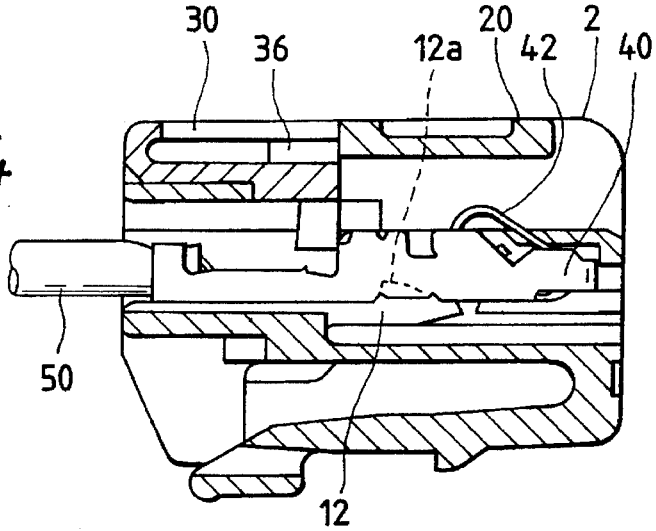
FIG. 4 is a cross-sectional view of the connector during transport, with terminals received in a housing body.
Figure 5:
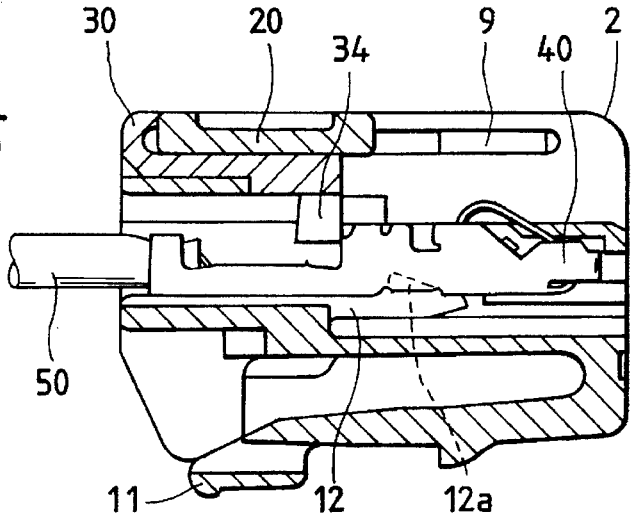
FIG. 5 is a cross-sectional view of the connector to be inserted into a mating casing.

When the terminal 40 is fully inserted into a proper position in the terminal receiving chamber 3, an elastic retaining piece portion (lance) 12, provided in the terminal receiving chamber 3, is first elastically deformed, and then is restored to cause its retaining projection 12*a* to fit in the engagement hole 41, as shown in FIGS. 4 and 5. As a result, the terminal 40 is held in position against rear withdrawal.

On the other hand, when the terminal 40 is in an incompletely-inserted condition (see FIG. 6) or when the terminal is inserted in an inverted condition (see FIG. 7), the lance 12 is kept elastically deformed.

Referring again to the assembling procedure with reference to FIG. 1, when all of the terminals 40 are inserted, the retainer 30 is further moved or pushed downward, so that each retaining projection 33*a* passes past the slanting surface 10*c* of the associated completely-engaging projection 10*b*, and is disposed beneath this slanting surface 10*c*. In this condition, each lower piece portion 33*b* of the retainer 30 is spaced downwardly from the associated provisionally-engaging projection 10*a* of the housing body 2. This condition is called the completely-retained condition of the retainer 30, and in this condition the upper surface of the retainer 30 and the upper surface of the housing body 2 are disposed in a common plane as shown in FIG. 2, and each detection projection 34 is held against the rear end of the electrical contact portion 43 of the associated terminal 40, thereby preventing the withdrawal of the terminal 40. Namely, this condition is the assembling-completed condition shown in FIGS. 2 and 4.

Figure 6:
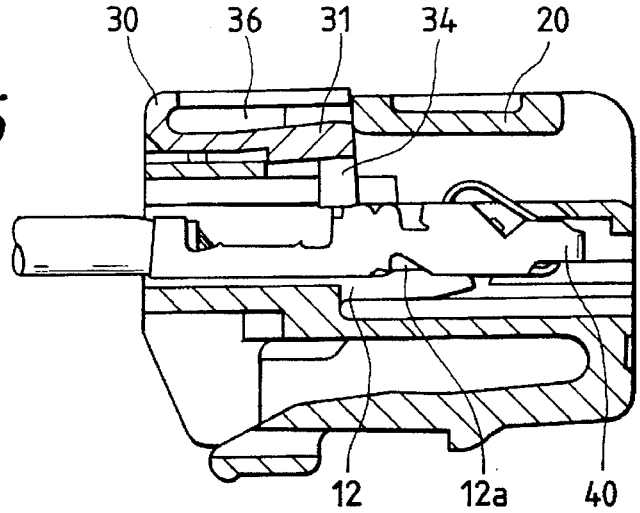
FIG. 6 is a cross-sectional view of the connector, with the terminal incompletely inserted in the housing body.
Figure 7:
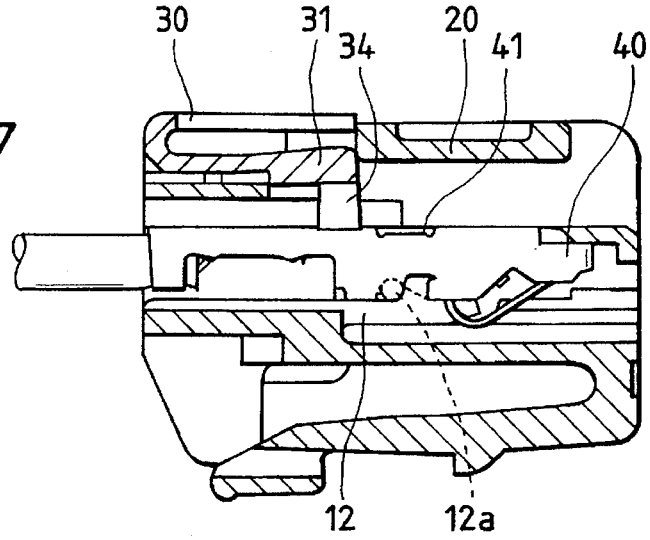
FIG. 7 is a cross-sectional view of the connector, with the terminal inserted in the housing body in a wrong manner.
Figure 8:
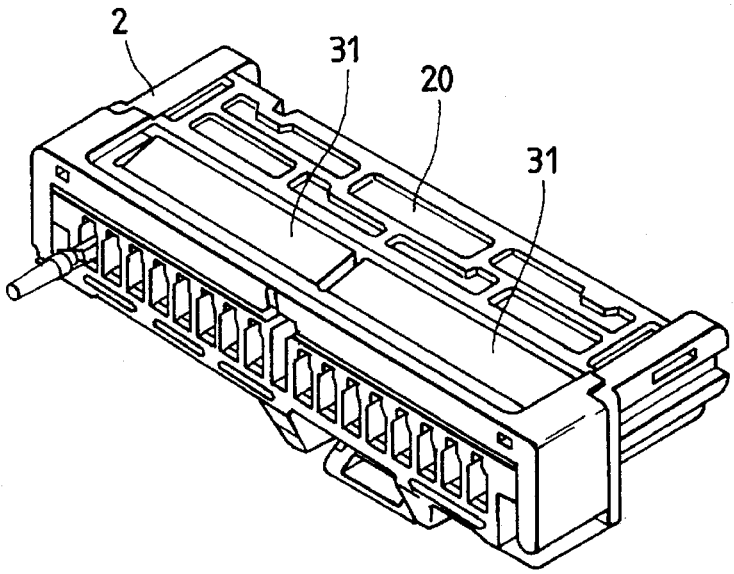
FIG. 8 is a perspective view of a connector of the invention in a condition in which a cover detects an incompletely-inserted terminal.
Figure 9A:
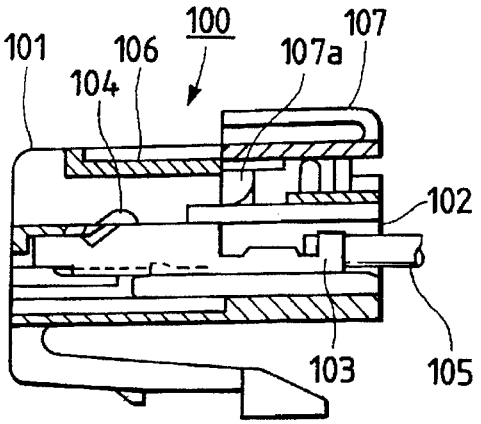
FIG. 9(A) PRIOR ART
FIG. 9(A) is a cross-sectional view of a conventional connector, showing an inserted terminal.
Figure 9B:
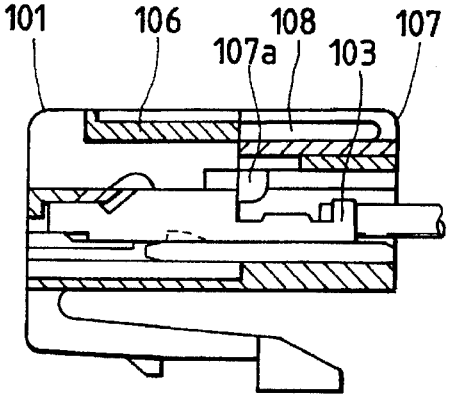
FIG. 9(B) PRIOR ART
FIG. 9(B) is a cross-sectional view of the conventional connector, showing a retainer in its completely-retained condition.
Figure 9C:
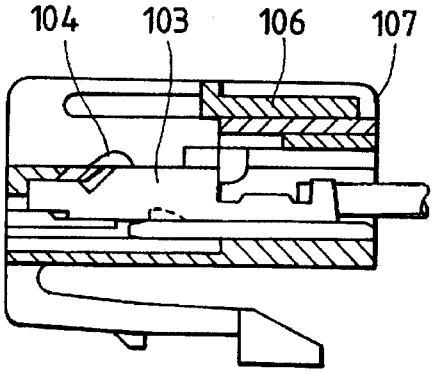
FIG. 9(C) PRIOR ART
FIG. 9(C) is a cross-sectional view of the conventional connector, showing a cover in its open condition.
Figure 10:
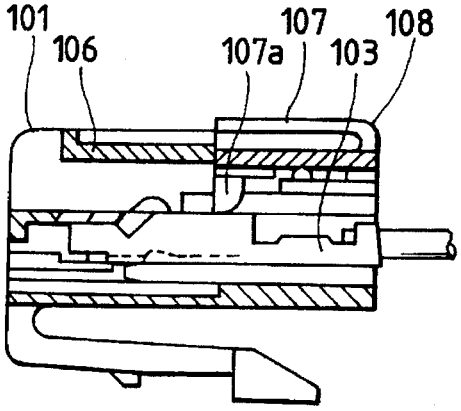
FIG. 10 PRIOR ART
FIG. 10 is a cross-sectional view of the connector of FIGS. 9(A) to 9(C), showing the terminal in an incompletely-inserted condition.

Here, if the terminal 40 is in an improperly-inserted condition as shown in FIG. 6 or FIG. 7, the detection projection 34 impinges on this terminal 40 when the retainer 30 is being shifted into the completely-retained condition, so that the retainer 30 can not be shifted into the completely-retained condition, and besides the horizontal plate 31 is urged into a substantially pivotally-moved condition. This condition is shown also in FIG. 8. In FIG. 8, there is shown a construction having 16 terminal receiving chambers 3, that is, 16 poles, and one section of a horizontal plate 31 corresponding to that group of terminals including the incompletely-inserted terminal is shown as urged upwardly.

If even part of the horizontal plate 31 is urged upwardly, the cover 20, received in the housing body 2, can not be opened to be slidingly moved into the retainer 30 since the cover 20 is brought into engagement with the edge of the horizontal plate 31, as is clear from FIGS. 6 to 8.

Thus, the inserted condition of the terminals 40 can be detected through the cover-opening operation.

After it is confirmed that all of the terminals 40 have been completely inserted, the connector 1 is connected to the mating casing 60, and is electrically connected to a printed circuit board.

Figure 3:
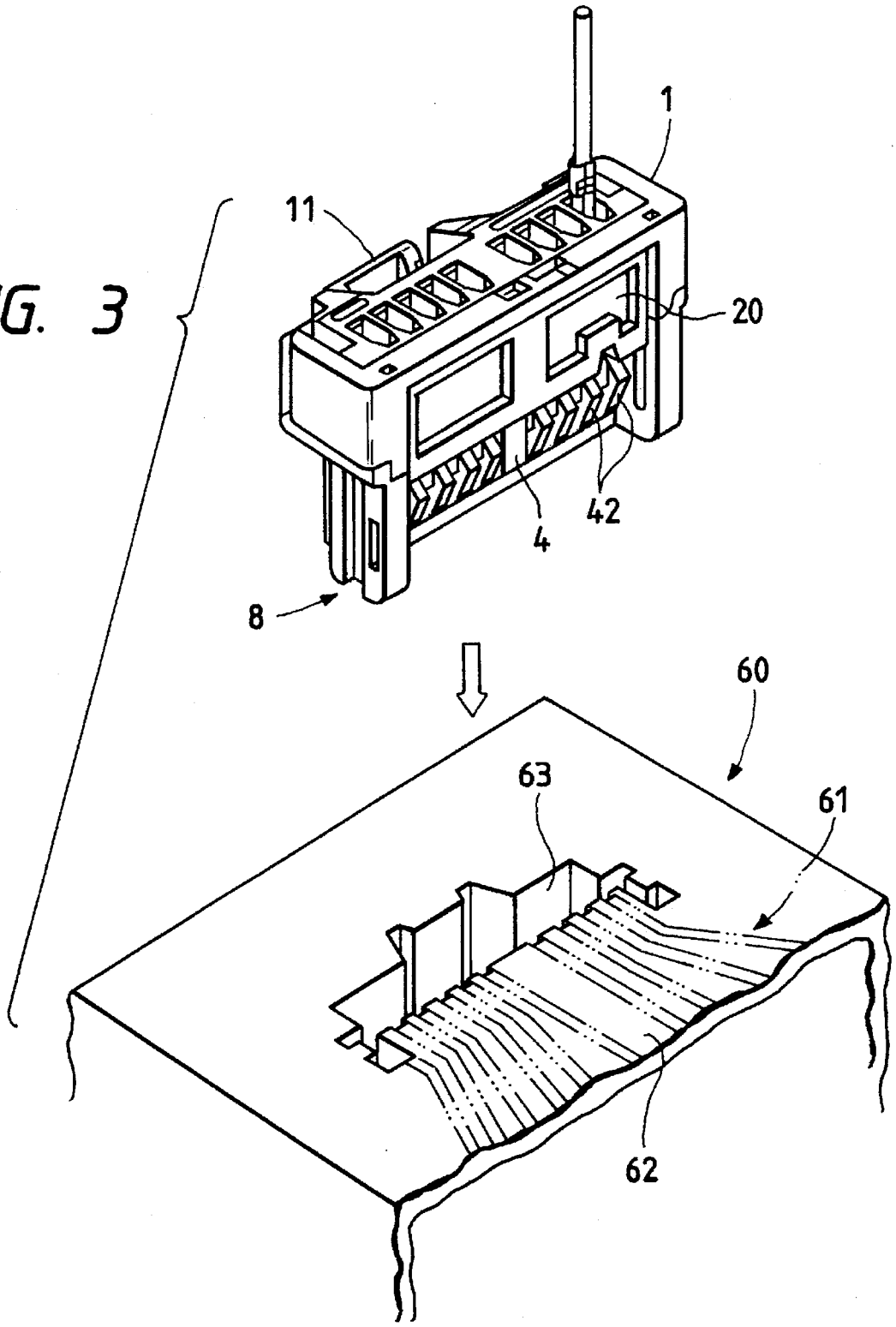
FIG. 3 is a perspective view showing a condition before the connector is fitted in a mating casing.

FIGS. 3 and 5 show this connected condition. The printed circuit board 61 is formed on a surface of the mating casing 60, and circuit pattern lines 62 are bent into a cavity portion 63 to form contact terminals (not shown).

In the connector 1, the cover 20 is slidingly moved from the upper surface 4 of the housing body 2 into the retainer 30, thereby exposing the contact piece portions 42 to the upper surface 4. For connecting the connector 1, the connector is kept in the above condition, and the rugged surfaces 8 of the opposite side plates 7 are fitted in corresponding portions of the cavity portion 63, respectively, and the lock arm 11 is engaged with an engagement projection (not shown) in the cavity portion 63. As a result, the contact piece portions 42 contact the mating contact terminals, respectively, thereby creating the electrical connection.

As described above in detail, in the connector of the present invention, the rib is always engaged in the engagement groove in the cover to thereby prevent the cover from being flexed or deformed, and even if the retainer, flexed by the incompletely-inserted terminal, is shifted into the completely-retained condition, the cover, when moved in its opening direction, impinges on the retainer, and is prevented from sliding movement. As a result, even in the connector of the multi-pole construction, any incompletely-inserted terminal can be positively detected. Besides, since the cover is prevented from being flexed, the cover can always be slidingly moved smoothly. Furthermore, since the cover is always engaged with the rib, the cover is prevented from disengagement from the housing body.

What is claimed is:

1. A connector comprising:

a housing body having at least two side plates and having a rib which is formed on and projects from an upper surface thereof, said rib being located between said two side plates, in said housing body; and a terminal incorporated in said housing body; and a cover, having an engagement groove in which the rib is fitted, slidably mounted on said housing body so as to expose said terminal by opening said cover, wherein said cover is engaged with said rib to be prevented from being elastically deformed, and disposed so as to be received in a retainer fitted on said housing body;

wherein said rib has a T-shaped cross-section, and said engagement groove, corresponding in shape to said rib, formed in a lower surface of said cover of a plate-like configuration so as to extend in a direction of sliding movement of said cover.

2. The connector according to claim 1, wherein said retainer has a substantial U-shape, and includes a horizontal plate which is movable substantially pivotally, and opposite side plates depending respectively from opposite ends of said horizontal plate, wherein said retainer is moved in a direction intersecting a terminal-inserting direction, and is selectively held in a provisionally-retained position and a completely-retained position by retaining means acting between said retainer and said housing body, and wherein in the completely-retained position of said retainer, said cover is slidable relative to said housing body whereas in the provisionally-retained position of said retainer, said cover impinges on said horizontal plate to be prevented from sliding movement.

3. The connector according to claim 2, wherein said housing body has a notch for exposing a contact piece portion of said terminal received in a terminal receiving chamber, and wherein said housing body has a slide groove slidably receiving said cover, said slide groove being provided at a side of said housing body at which said contact piece portion is disposed.

4. The connector according to claim 2, wherein said retainer has a cover movement groove for receiving said cover, said cover movement groove being provided between said horizontal plate and one of said opposite side plates, and wherein said retainer has a detection projection, formed on a lower surface of said horizontal plate, for detecting an inserted condition of said terminal.

5. The connector according to claim 4, wherein said horizontal plate has at least one pair of slits formed therethrough so as to extend in the terminal-inserting direction, so that said horizontal plate is movable substantially pivotally.

* * * * *